US007867025B2

(12) United States Patent
Montena

(10) Patent No.: US 7,867,025 B2
(45) Date of Patent: Jan. 11, 2011

(54) CABLE CONNECTOR WITH SUPPORTED CENTER CONDUCTOR CONTACT

(75) Inventor: Noah Montena, Syracuse, NY (US)

(73) Assignee: John Mezzalingua, Associates, Inc., East Syracuse, NY (US)

( * ) Notice: Subject to any disclaimer, the term of this patent is extended or adjusted under 35 U.S.C. 154(b) by 8 days.

(21) Appl. No.: 12/474,831

(22) Filed: May 29, 2009

(65) Prior Publication Data

US 2010/0304606 A1 Dec. 2, 2010

(51) Int. Cl.
*H01R 9/05* (2006.01)

(52) U.S. Cl. ..... 439/578

(58) Field of Classification Search ..... 439/578, 439/584, 585

See application file for complete search history.

(56) References Cited

U.S. PATENT DOCUMENTS 3,353,144 A 11/1967 Brookman
3,976,352 A 8/1976 Spinner
5,185,500 A 2/1993 Spinner
5,899,769 A 5/1999 Konetschny et al.
5,960,140 A 9/1999 Caplan et al.
6,431,911 B2 8/2002 Pitschi
6,716,061 B2 4/2004 Pitschi et al.
6,976,872 B1 * 12/2005 Wild et al. ..... 439/578
7,008,264 B2 3/2006 Wild
7,357,671 B2 4/2008 Wild et al.
7,374,455 B2 5/2008 Purdy et al.
2005/0170693 A1 * 8/2005 Wild ..... 439/578
2007/0149047 A1 6/2007 Wild et al.
2008/0139047 A1 6/2008 Montena

* cited by examiner

*Primary Examiner*—Tho D Ta
(74) *Attorney, Agent, or Firm*—Marjama Muldoon Blasiak & Sullivan LLP

(57) ABSTRACT

A cable connector for a coaxial cable includes at one end a basket with circumferentially spaced fingers extending generally axially toward the other end of the cable connector. The fingers define a cavity that is positioned in surrounding relation to a inner conductive pin. Disposed in the cavity is a cylindrical collar which engages an inner wall of the fingers, along a substantial portion of their length, so as to bias them radially outwardly and prevent stresses that may otherwise occur when the fingers are inserted into the inner conductor of a coaxial cable.

14 Claims, 2 Drawing Sheets

CABLE CONNECTOR WITH SUPPORTED CENTER CONDUCTOR CONTACT

TECHNICAL FIELD

This invention relates generally to connectors for coaxial cables, and more particularly, to a connector for establishing electrical signal conduction with a radially inwardly facing conductive surface of a cable.

BACKGROUND

Coaxial cables of large sizes are commonly made of two concentric conductive sections. Typically these sections include a relatively large hollow outer conductor, and a smaller hollow center conductor that is concentrically disposed inside of the outer conductor. It is also likely that the two conductors are isolated from one another with insulation that is disposed between the two conductors.

The center conductor is commonly formed as a thin walled tube and may have corrugations on its inner surface to facilitate bending. While serving the purpose of improving the bending characteristics of the conductor, and the coaxial cable overall, the corrugations can interfere with the electrical contact that is required between the radially inwardly facing conductive surface of the center conductor and a corresponding radially outer surface of a center conductor of a coaxial connector. A number of alternative designs for connector assemblies have therefore been developed for the purpose of establishing and maintaining electrical connection between these particular portions of the cable and the connector.

For example, connector technology that addresses this has been described in U.S. Pat. No. 7,374,455 to Purdy et al., which discloses and describes a flexible tube with slots that are inserted into a hollow center conductor of the coaxial cable. The slots define distinct fingers, which are urged against a radially inwardly facing conductive surface, and which have open ends that extend in the direction of the hollow center conductor. These fingers may have a tendency to catch, or otherwise become obstructed by, the leading edge of the hollow center conductor when the fingers are inserted into a hollow center conductor. This may occur even though the ends of the fingers may be bent radially inwardly.

An alternative design is also shown in U.S. Pat. No. 7,357,671 to Wild et al. and U.S. Patent Publication No. 2007/0149047 filed on Dec. 20, 2006 by Wild et al., both of which disclose and illustrate a connector pin that has fingers attached so that the open ends extend in the opposite direction. That is, the open ends extend in a direction away from the leading edge of the hollow center conductor of the coaxial cable when the hollow center conductor and the connector center conductor are brought together for insertion of the connector pin into the hollow center conductor. Unfortunately, although this design facilitates insertion of the fingers of the connector pin into the hollow center conductor, support for the fingers is provided only at the opposing ends of the fingers. It does not, for example, support any other portion of the fingers, and particularly the portions of the fingers that are subject to bending stresses. This may ultimately lead to a deformation of the fingers and thereby result in reduced electrical contact, and eventually in inadequate electrical contact between the hollow center conductor of the coaxial cable and the center conductor of the connector.

Therefore, there is a need for a connector that has a center conductor with flexible fingers for making electrical connection with the inner conductor of corrugated coaxial cable, but that does not suffer from degradation in electrical signal conduction between the center conductor and the inner conductor. It is likewise desirable that the flexible fingers of the connector are supported in a manner that reduces the effect of bending stresses. It is even more desirable that the connector include support and/or supporting elements that extend along the entire length of the flexible fingers.

SUMMARY OF THE INVENTION

Briefly, the present invention provides a cable connector with a center conductor that has a portion that is resiliently supported in order to maintain electrical signal conduction with a coaxial cable. As discussed in more detail below, embodiments of the cable connector that are made in accordance with concepts of the present invention include a center conductor that has at one end a basket with circumferentially spaced fingers, which extend toward a pin on the other end. A resilient collar is disposed in a space between the pin and the fingers so as to provide a radial outward force against the fingers as they tend to flex inwardly when inserted into a corresponding inner conductor of a coaxial cable. In one embodiment of the cable connector, the pin includes a shelf and a flange, and said cylindrical collar is disposed between a shelf and the flange.

Further, in accordance with another embodiment, the cable connector includes a pin having at one end a terminal for establishing electrical contact with a mating terminal, and a basket having a base and having attached thereto a plurality of circumferentially spaced fingers with slots therebetween. The fingers extend generally in a first direction parallel to the axis of the basket to define a basket cavity, such fingers being flexible radially outwardly so as to enable the establishment of electrical contact with an inner wall of a coaxial cable center conductor when axially installed in a direction opposite to the first direction. The cable connector also includes a cylindrical collar disposed concentrically on a shank portion of the pin, the collar being composed of an elastic material, and being disposed, along with the pin, in the basket cavity such that, when the basket is inserted into the center conductor of a coaxial cable, the collar is caused to engage the inner wall of the fingers, over a substantial longitudinal portion thereof.

In accordance with another embodiment, a method of manufacturing a coaxial cable connector includes the steps of forming a pin having at one end a terminal for establishing electrical contact with a mating terminal, and forming a basket having a base and having attached thereto a plurality of circumferentially spaced fingers with slots therebetween. The fingers extend generally in a first direction parallel to the axis of the basket to define a basket cavity, such fingers being flexible radially outwardly so as to enable the establishment of electrical contact with an inner wall of a coaxial cable center conductor when axially installed in a direction opposite to the first direction. The method also includes forming a cylindrical collar and installing it concentrically on a shank portion of the pin, the collar being composed of an elastic material, installing the collar and pin in the basket cavity such that, when the basket is inserted into the cable center conductor, the collar is caused to engage the inner wall of the fingers, over a substantial longitudinal portion thereof, so as to prevent undo stress that would otherwise occur in the fingers.

BRIEF DESCRIPTION OF THE DRAWINGS

A more particular description of the invention briefly summarized above, may be had by reference to the embodiments, some of which are illustrated in the accompanying drawings.

It is to be noted, however, that the appended drawings illustrate only typical embodiments of this invention and are therefore not to be considered limiting of its scope, for the invention may admit to other equally effective embodiments. Thus, for further understanding of the nature and objects of the invention, references can be made to the following detailed description, read in connection with the drawings in which.

DETAILED DESCRIPTION OF THE INVENTION

Figure 1:
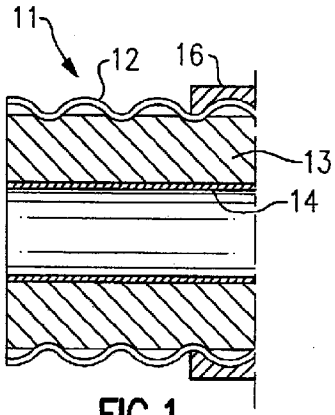
FIG. 1 is an axial sectional view of a coaxial cable into which the connector of the present invention is intended to fit.

Referring now to the drawings, FIG. 1 illustrates an end portion 11 of a typical coaxial cable that is used in connection with embodiments of the cable connector disclosed and described herein. The end portion 11 includes a tubular corrugated outer cable conductor 12, a tubular dielectric 13, and a tubular inner cable conductor 14. A cable sheath 16 is disposed in surrounding relation to the outer surface of the coaxial cable. As discussed in more detail below, cable connectors that are made in accordance with the concepts of the present invention are adapted to electrically connect with each of the outer cable conductor 12 and the inner cable conductor 14. More particularly, these cable connectors are constructed in a manner that improves the quality, and consistency with which electrical signals are conducted between the cable connector and the inner conductor 14.

Figure 2:
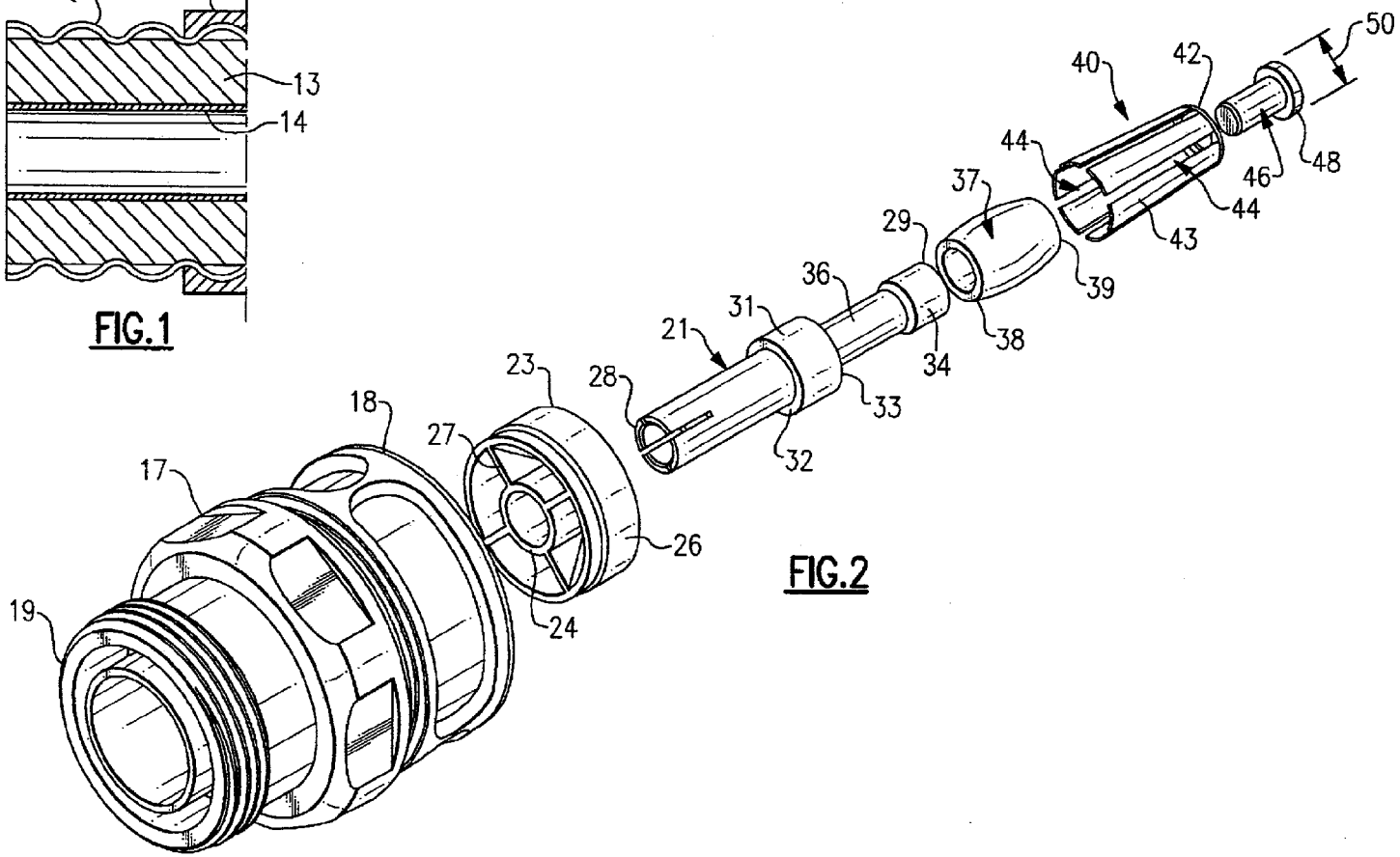
FIG. 2 is an exploded perspective view of the parts of the cable connector in accordance with the present invention.
Figure 3:
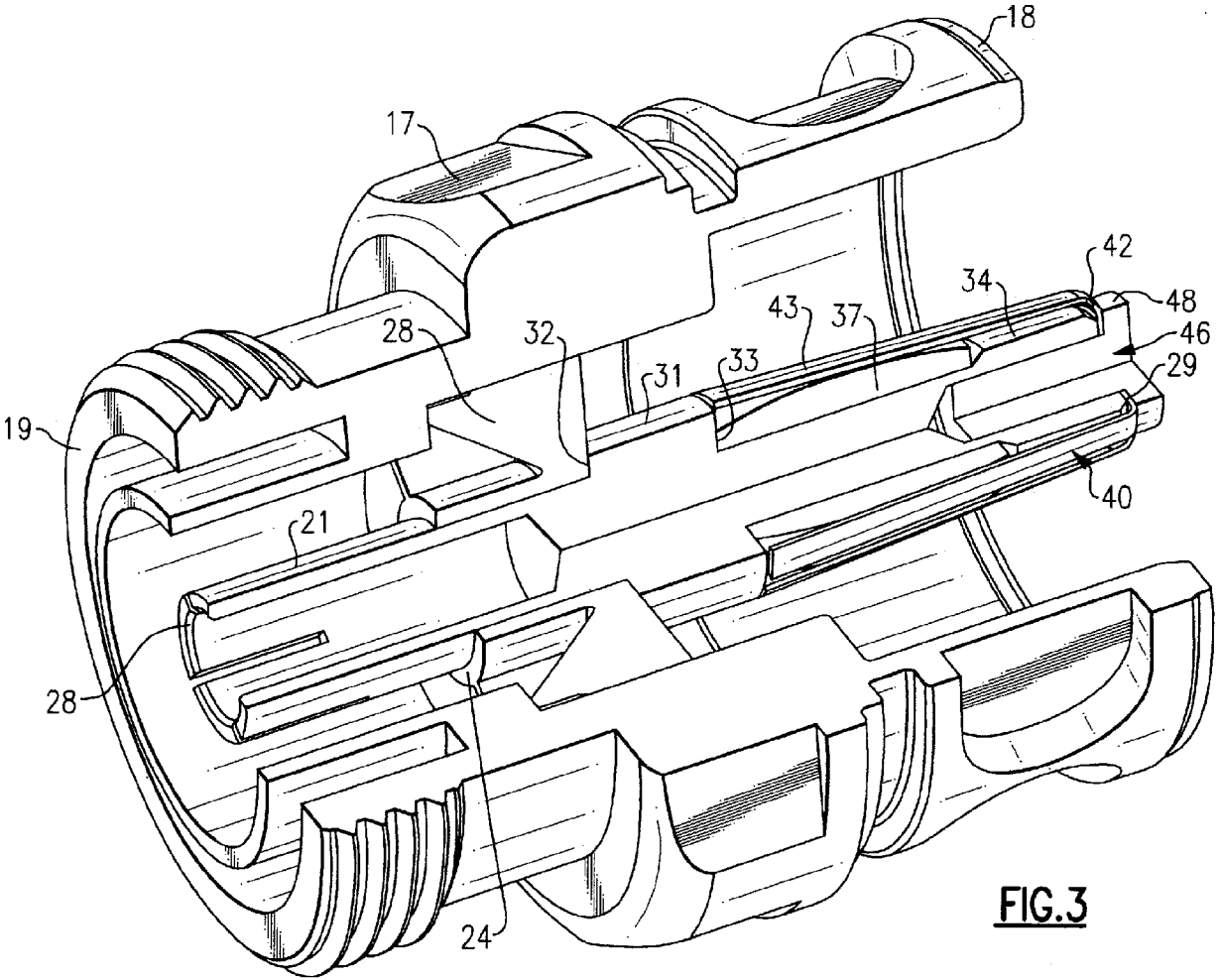
FIG. 3 is a partial cutaway perspective view thereof in the assembled condition.
Figure 3:
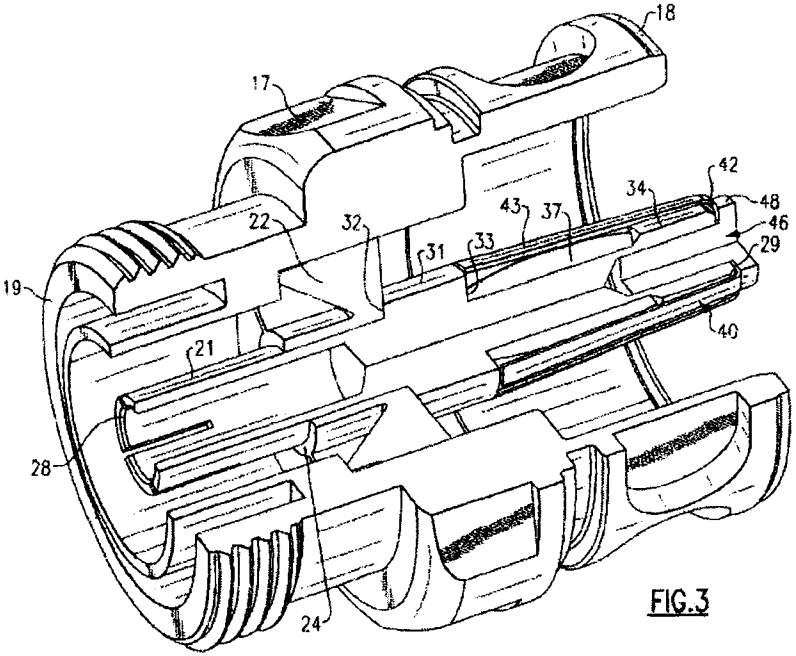

For example, it is shown in FIGS. 2-3 that embodiments of the cable connector can have electrically conductive surfaces that are radially supported so as to improve the contact between the cable connector and the inner conductor 14. The radial support can be provided in a manner that repeated insertion and removal of the cable connector from the coaxial cable does not cause substantial degradation to the electrical connection of the cable connector with the inner conductor 14. Moreover, connectors of the type disclosed and described herein are constructed with contact surfaces that deviate from some nominal position to at least one other position in order to electrically connect with the inner conductor 14. Although the change in this position may result in stress, strain, and other forces that would normally act on the components of the cable connector that have, and/or form, the contact surfaces, such stress is substantially, or at least somewhat diminished because of the radial support.

As it was discussed in the Background section above, the inner conductor, e.g., the inner conductor 14, that is found in some coaxial cables improves the flexibility of the cable, but at the detriment of the electrical connection between the inner conductor 14 and the cable connector. The radial support that is found in embodiments of the cable connector disclosed herein, however, improves this electrical connection because it provides a radial support to flexible fingers, which have the contact surfaces disposed thereon. These fingers, while offering advantages of construction that can accommodate for differences in the inner conductor, are by their nature relatively susceptible to external stress. On the other hand, the radial support that is found in cable connectors that are made in accordance with the present invention substantially mitigate the damage caused by some of these external stresses in a manner that improves the useful life of the fingers. That is, the fingers are better able to position the contact surfaces in relation to the inner conductor to the extent necessary for electrical signal conduction, and in a manner that prolongs the useful life of the cable connector.

As an example of this concept, as well as other concepts of the present invention, reference is now made to FIG. 2 where one embodiment of a cable connector is shown in an exploded view. The cable connector includes a connector body 17 having a cable end 18 and a terminal end 19. The cable end 18 is adapted to be electrically connected to the outer cable conductor 12, and the terminal end 19 is adapted to be connected to a related terminal (not shown).

An inner conductor pin 21 is disposed concentrically within the connector body 17, and an insulator 23 is provided so as to position the inner conductor pin 21 in electrical isolation from the body 17. The insulator 23 includes an inner hub 24, an outer hub 26, and a plurality of spokes 27 that connects the inner hub 24 and the outer hub 26. The inner conductor pin 21 has a terminal end 28 and a cable end 29, with the terminal end 28 being adapted to make electrical connection with a corresponding inner conductor terminal on a device or other cable, e.g., coaxial cable 11 (FIG. 1), and the cable end 29 being adapted to make electrical connection with the inner conductor 14 (FIG. 1) in an indirect manner as will be described hereinafter.

In the present example, the cable connector also includes a cylindrical portion 31 that has a terminal shoulder 32 and a cable shoulder 33. It is seen in the embodiment of the cable connector of FIG. 2, that the cylindrical portion 31 is disposed concentrically on the outer surface of the terminal pin 21, and located at an intermediate position with respect to the terminal end 28 and the cable end 29. The pin terminal end 28 is designed to extend coaxially through the inner hub 24 of the insulator 22, with the end of the inner hub 24 being adapted to engage the terminal shoulder 32. This feature is discussed in connection with the embodiment of the cable connector that is illustrated in FIG. 3 and described below.

Discussing the cable end 29 of the inner conductor pin 21 in more detail, it is seen that the inner conductor pin 21 has a cylindrical flange 34 and a shank portion 36, where the cylindrical flange 34 is disposed concentrically on the shank portion 36. A cylindrical collar 37 that has a cable shoulder end 38, and a securing end 39 is disposed on the inner conductor pin 21. By way of non-limiting example, in one construction of the cable connector, the cable shoulder end 38 of the cylindrical collar 37 is slid onto the inner conductor pin 21 so that the cylindrical collar 37 is positioned at a location on the inner conductor pin 21 that is between the cable shoulder 33 and the flange 34.

The cylindrical collar 37 may be constructed so that it has some elastic properties. This includes, for example, properties that are resilient and/or that resist permanent deformation of the outer surfaces of the cylindrical collar 37. In one preferred embodiment of the cable connector, the cylindrical collar 37 is constructed so that it can apply forces that radiate generally outwardly from the inner conductor pin 21. Exemplary materials for use in the cylindrical collar 37 include, but are not limited to, elastic materials, and polymers that exhibit elastic properties.

In other embodiments of the cable connector, the material and construction of the cylindrical collar 37 may be selected so that the cylindrical collar 37 is composed of a material that has a relatively low Young's modulus of between 1 and 25 MPa, like natural rubber, nitrile rubber, silicone rubber, styrene butadiene rubber, ethylene propylene diene rubber, urethane rubber, etc. Elastomers in general have a relatively low Young's modulus so that they can be elastically compressed in an axial direction to create a radial deflection of the elastomer with a relatively low compressive force. Such elastomers can also have relatively low compressibility properties so that the material maintains a relatively consistent volume during an elastic deflection. This allows for an efficient transfer of an axial deflection into a radial deflection. It may be desirable, for example that the cylindrical collar 37 is constructed, in whole or in part, of silicone rubber.

The term "relatively" is used above in an effort to define the desired properties of the cylindrical collar 37, while it also allows design modifications that are envisaged to be within the scope of the present invention. In other words, it is envisaged that the cylindrical collar 37 could be manufactured of a more rigid and/or more compressible material. In the case of a more rigid material, the cylindrical collar 37 could be made having a thinner cross section and/or the installation tools could be made to provide a greater amount of installation force. Similarly, it is envisaged that a more compressible material could be used for the cylindrical collar 37, and in particular, such a material may be used when less actual radial deflection is desired while using the same amount of axial deflection.

The cable conductor further includes a basket 40 with a basket cavity 41, which fits concentrically over the outer surface of the cylindrical collar 37. The basket cavity 41 in the present example is defined by an annular base member 42 and a plurality of circumferentially spaced fingers 43. Each of the circumferentially spaced fingers 43 may extend from the annular base member 42 toward the terminal end 28 of the inner conductor pin 21. In one embodiment of the cable connector, the basket 40 includes a number of axially extending slots 44 that are located between the fingers 43 so as to circumferentially space and separate adjacent ones of the fingers 43.

The fingers 43 are generally composed of resilient materials so that each of the fingers 43 can deviate from, and return to, a nominal position. This material may be electrically conductive, or in other constructions of the cable connector the material may have a conductive material that is disposed thereon. Materials that are suited for use in the fingers 43 includes, but are not limited to, metals (e.g., copper), plastics, composites, and any combination thereof. In one example, the material for the fingers 43 is a spring-like material such as copper.

The cable connector can also include a securing pin 46 that has an end shoulder 48 with an outer diameter 50 that is sized and configured so that the end shoulder 48 can mate with a portion of the annular base member 42. More particularly, the annular base member 42, as well as the inner conductor pin 21 may be open at one end so as to receive the securing pin 46 therein. This concept is illustrated and discussed in more detail in connection with assembled cable connector of FIG. 3 below.

For example, another embodiment of a cable connector is illustrated in assembled form in FIG. 3, where numerals are used to designate like components, such as those components in FIG. 2 above. In this embodiment, it is seen that the insulator 22 concentrically centers the pin 21, in an electrically insulated manner, in the body 17, with the terminal shoulder 32 of the pin cylindrical portion 31 engaging the one side of the insulator 32. Further, the cylindrical collar 37 is disposed concentrically on the inner conductor pin 21 between the cylindrical portion 31 and the flange 34. The plurality of fingers 43 extend from the pin cable end 29, over the flange 34 and the cylindrical collar 37 to the pin cable shoulder 33 as shown. The basket 40 and its supporting elements are adapted to be inserted into the tubular inner conductor 14 of the cable as to establish and maintain electrical engagement for electrical conductivity therebetween.

It should be understood that the process of connecting the connector with the coaxial cable will be made easier, inasmuch as the individual fingers 43 of the basket 40 extend toward the terminal end 28 rather than toward the end of the inner conductor 14. Moreover, since the cylindrical collar 37 is engaged with the inner wall of the fingers 43 over a substantial portion of their lengths, the fingers 43 are radially supported to mitigate the stresses that would otherwise occur in the fingers by virtue of their cantilevered condition with respect to, for example, the annular base member 42. Also, the cylindrical collar 37 reinforces the radial outward force of the fingers so as to establish better contact with the inner wall of the inner conductor 14.

More particularly, and with continued reference to FIG. 3, and also to FIG. 1, in one implementation of the cable connector, the inner conductor 14 of the coaxial cable 11 is inserted over the pin cable end 29 and slid onto the basket 40 and into the cable connector. This creates the electrical contact between the outer surface of the fingers 43 of the basket 40 and the inner surface of the inner conductor 14. It also can apply a downward force on the fingers 43, which can compress the fingers 43 so that the fingers 43 compress the cylindrical collar 37. Typically the downward force is generated as a result of mismatches, tolerances, and other deviations amongst the dimensions of the inner conductor 14, the fingers 43, the cylindrical collar 37, as well as the other components of the cable connector.

While the present invention has been described with reference to a particular preferred embodiment and the accompanying drawings, it will be understood by those skilled in the art that the invention is not limited to the preferred embodiment and that various modifications and the like could be made thereto without departing from the scope of the invention as defined in the following claims.

What is claimed is:

1. A coaxial cable connector comprising:

a pin having at one end a terminal for establishing electrical contact with a mating terminal;

a basket having a base and having attached thereto a plurality of circumferentially spaced fingers with slots therebetween, said fingers extending generally in a first direction parallel to the axis of said basket to define a basket cavity, such fingers being flexible radially outwardly so as to enable the establishment of electrical contact with an inner wall of a coaxial cable center conductor when axially installed therein, in a direction opposite to said first direction; and a cylindrical collar disposed concentrically on a shank portion of said pin, said collar being composed of an elastic material, and being disposed, along with said pin, in said basket cavity such that, when said basket is inserted into said cable center conductor, said collar is caused to engage the inner wall of said fingers, over a substantial longitudinal portion thereof.

2. A coaxial cable connector as set forth in claim 1 wherein said pin includes a radially extending flange at its other end and a radially extending shelf at an intermediate position thereon and further wherein said collar is disposed between said shelf and said flange.

3. A coaxial cable as set forth in claim 1 wherein said collar is composed of an elastomeric material.

4. A coaxial cable connector set forth in claim 3, and such collar composed of silicone rubber.

5. A coaxial cable connector as set forth in claim 1, and including an outer body and an insulator disposed concentrically therein, said insulator having an inner hub into which a said pin is concentrically disposed such that the insulator positions said pin within said body and electrically isolates it therefrom.

6. A coaxial cable connector as set forth in claim 5 wherein said pin includes a radially extending face which interfaces with a face of said insulator when the pin is installed in said insulator.

7. A coaxial cable connector as set forth in claim 1 wherein said basket has an opening in its base, and a securing pin is included to pass through said base opening and into said pin other end.

8. A method of manufacturing a coaxial cable connector comprising the steps of:

forming a pin having at one end a terminal for establishing electrical contact with a mating terminal;

forming a basket having a base and having attached thereto a plurality of circumferentially spaced fingers with slots therebetween, said fingers extending generally in a first direction parallel to the axis of said basket to define a basket cavity, such fingers being flexible radially outwardly so as to enable the establishment of electrical contact with an inner wall of a coaxial cable center conductor when axially installed therein, in a direction opposite to said first direction;

forming a cylindrical collar and installing it concentrically on a shank portion of said pin, said collar being composed of an elastic material; and installing said collar and pin in said basket cavity such that, when said basket is inserted into said cable center conductor, said collar is caused to engage the inner wall of said fingers, over a substantial longitudinal portion thereof, so as to prevent undo stress that would otherwise occur in said fingers.

9. A method as set forth in claim 8 and including the steps of forming a radially extending flange on the other end of said pin, forming a radially extending shelf at an intermediate position thereon and installing said collar between said shelf and said flange.

10. A method as set forth in claim 8 wherein said collar is composed of an elastomeric material.

11. A method as set forth in claim 10, and such collar composed of silicone rubber.

12. A method as set forth in claim 8, and including the steps of providing an outer body and an insulator disposed concentrically therein, said insulator having an inner hub into which a said pin is concentrically installed such that the insulator positions said pin within said body and electrically isolates it therefrom.

13. A method as set forth in claim 12 wherein said pin includes a radially extending face which interfaces with a face of said insulator when the pin is installed in said insulator.

14. A method as set forth in claim 8 and including the steps of providing an opening in said basket base, and securing said basket in place by passing a securing pin through said base opening and into said pin other end.

* * * * *

UNITED STATES PATENT AND TRADEMARK OFFICE

CERTIFICATE OF CORRECTION

PATENT NO. : 7,867,025 B2
APPLICATION NO. : 12/474831
DATED : January 11, 2011
INVENTOR(S) : Noah Montena It is certified that error appears in the above-identified patent and that said Letters Patent is hereby corrected as shown below:

In the drawings, sheet 1, FIG. 2, reference numeral 44 applied to the basket cavity should read -- 41 --.

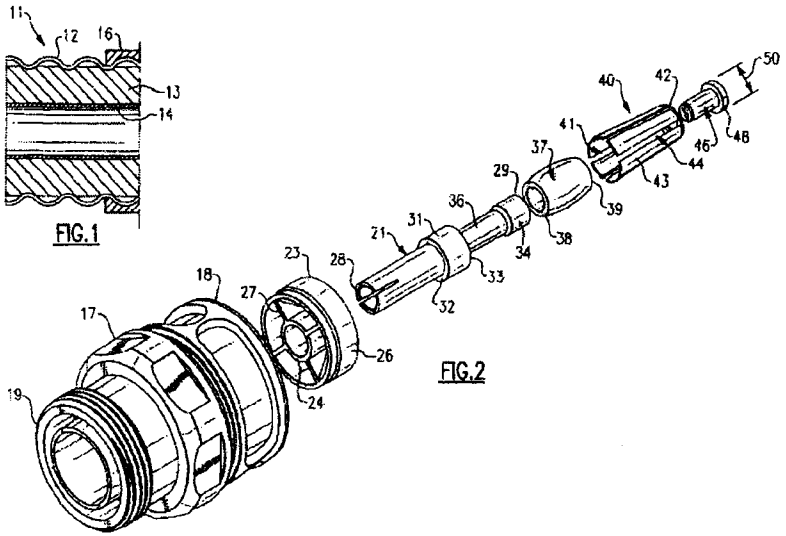

Signed and Sealed this
Fourteenth Day of August, 2012

David J. Kappos
*Director of the United States Patent and Trademark Office*

In the drawings, sheet 2, FIG. 3, reference numeral 28 applied to the insulator should read -- 22 --.